US009437975B2

(12) United States Patent
Lee et al.

(10) Patent No.: US 9,437,975 B2
(45) Date of Patent: Sep. 6, 2016

(54) CROSSTALK-PROOF RECEPTACLE CONNECTOR

(71) Applicant: Advanced-Connectek Inc., New Taipei (TW)

(72) Inventors: Kuo-Ching Lee, New Taipei (TW); Jian-Li Guan, Tian-Jin (CN); Ya-Ping Liang, New Taipei (TW); Yao-Te Wang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/221,748

(22) Filed: Mar. 21, 2014

(65) Prior Publication Data

US 2014/0295705 A1 Oct. 2, 2014

(30) Foreign Application Priority Data

Mar. 26, 2013 (CN) ..... 2013 2 0140656 U

(51) Int. Cl.

| | |
|---|---|
| ***H01R 13/648*** | (2006.01) |
| ***H01R 13/6461*** | (2011.01) |
| ***H01R 12/72*** | (2011.01) |
| ***H01R 13/514*** | (2006.01) |
| ***H01R 13/6474*** | (2011.01) |
| *H01R 13/6587* | (2011.01) |

(52) U.S. Cl.

CPC ..... *H01R 13/6461* (2013.01); *H01R 12/724* (2013.01); *H01R 13/514* (2013.01); *H01R 13/6474* (2013.01); *H01R 13/6587* (2013.01)

(58) Field of Classification Search

CPC ..... H01R 13/6461; H01R 12/724; H01R 13/514; H01R 13/6474; H01R 13/6587

USPC ..... 439/607.05, 607.34, 95, 607.37, 439/607.35, 607.23, 607.28

See application file for complete search history.

(56) References Cited

U.S. PATENT DOCUMENTS

| | | | | |
|---|---|---|---|---|
| 6,409,543 | B1 * | 6/2002 | Astbury, Jr. | H01R 13/65807 439/607.07 |
| 6,743,057 | B2 * | 6/2004 | Davis | H01R 23/688 439/607.05 |
| 6,986,682 | B1 * | 1/2006 | Jeon | H01R 23/6873 439/607.07 |
| 7,074,086 | B2 * | 7/2006 | Cohen | H01R 23/688 439/607.08 |
| 7,347,740 | B2 * | 3/2008 | Minich | H01R 13/514 439/607.05 |
| 7,410,393 | B1 * | 8/2008 | Rothermel | H01R 29/00 439/49 |
| 8,182,289 | B2 * | 5/2012 | Stokoe | H01R 23/688 439/607.07 |
| 8,870,594 | B2 * | 10/2014 | McClellan | H01R 9/22 439/607.05 |
| 8,894,442 | B2 * | 11/2014 | McClellan | H01R 13/648 439/607.05 |
| 2004/0224559 | A1 * | 11/2004 | Nelson | H01R 13/514 439/607.05 |
| 2007/0004282 | A1 * | 1/2007 | Cohen | H01R 13/514 439/607.02 |

(Continued)

*Primary Examiner* — Tho D Ta
*Assistant Examiner* — Nader Alhawamdeh

(57) ABSTRACT

A crosstalk-proof receptacle connector has multiple insulative boards, multiple sets of terminals, multiple sets of shielding plates and an outer casing. The insulative boards are arranged abreast. The sets of the terminals are mounted respectively in the insulative boards. The terminals of each set are classified into signal terminals and grounding terminals. Each set of the shielding plates is mounted on one of two opposite sides of a corresponding insulative board. The shielding plates of each set are spaced apart without contacting one another. Each shielding plate has multiple folding sections capable of interrupting signal noise. The outer casing covers the insulative boards to combine the insulative boards. The sets of the shielding plates decrease signal interference of the receptacle connector and improve signal transmission efficiency and stability.

11 Claims, 12 Drawing Sheets

(56) References Cited

U.S. PATENT DOCUMENTS

2007/0155241 A1* 7/2007 Lappohn ..... H01R 13/514 439/607.07
2008/0214029 A1* 9/2008 Lemke ..... H01R 13/6471 439/108
2009/0035955 A1* 2/2009 McNamara ..... H01R 13/514 439/65
2009/0093158 A1* 4/2009 McAlonis ..... H01R 13/514 439/607.41
2009/0227141 A1* 9/2009 Pan ..... H01R 23/688 439/607.03
2009/0233471 A1* 9/2009 Pan ..... H01R 13/514 439/108
2010/0197149 A1* 8/2010 Davis ..... H01R 12/727 439/59
2010/0240233 A1* 9/2010 Johnescu ..... H01R 13/514 439/108
2011/0117781 A1* 5/2011 Stoner ..... H01R 13/6587 439/607.01
2011/0189892 A1* 8/2011 Mizukami ..... H01R 13/648 439/607.34
2011/0212649 A1* 9/2011 Stokoe ..... H01R 23/688 439/626
2012/0184140 A1* 7/2012 Davis ..... H01R 12/724 439/607.34
2012/0214343 A1* 8/2012 Buck ..... H01R 13/6586 439/607.05

* cited by examiner

CROSSTALK-PROOF RECEPTACLE CONNECTOR

BACKGROUND OF THE INVENTION

1. Field of the Invention

The present invention relates to a connector, and more particularly to a crosstalk-proof receptacle connector that effectively prevents crosstalk between signal terminals.

2. Description of Related Art

Servers such as blade servers and rack mount servers have printed circuit boards (PCBs) mounted with connectors for high speed and stable signal transmission. Such high speed connectors have compactly arranged terminals for massive signal transmission. However, crosstalk usually occurs between adjacent terminals and becomes worse when the signal terminals are operated to transmit high frequency signals, which lowers the efficiency of signal transmission and even causes failure of signal transmission.

With reference to FIG. 12, to prevent the aforementioned crosstalk, an improved connector has been developed. The connector has multiple insulative boards 90, multiple metal shielding plates 92 and a casing 93. The insulative boards 90 are arranged abreast and each insulative board 90 has a set of multiple terminals 91 mounted thereon. The metal shielding plates 92 are mounted respectively on the insulative boards 90 and are arranged alternately with the insulative boards 90 so that each metal shielding plate 92 is between two adjacent sets of the terminals 91. The casing 93 covers the insulative boards 90. The aforementioned arrangement of the connector is able to prevent the signal interference between adjacent sets of the terminals 91 on two opposite sides of one metal shielding plate 92. However, the metal shielding plate 92 is a single piece with sufficient width and length and therefore provides a sufficient long and diagonal path $P_0$ to allow electric charges to run thereon, which causes antenna effect and additional signal interference. For example, the diagonal path $P_0$ on the metal shielding plate 92 is the longest path and easily causes antenna effect.

To overcome the shortcomings, the present invention provides a crosstalk-proof receptacle connector to mitigate or obviate the aforementioned problems.

SUMMARY OF THE INVENTION

The main objective of the invention is to provide a crosstalk-proof receptacle connector that effectively prevents crosstalk between signal terminals.

A crosstalk-proof receptacle connector in accordance with the present invention comprises multiple insulative boards, multiple sets of terminals, multiple sets of shielding plates and an outer casing. The insulative boards are arranged abreast. The sets of the terminals are mounted respectively in the insulative boards. The terminals of each set are classified into signal terminals and grounding terminals. Each set of the shielding plates is mounted on one of two opposite sides of a corresponding insulative board. The shielding plates of each set are spaced apart without contacting one another. Each shielding plate has multiple folding sections capable of interrupting signal noise. The outer casing covers the insulative boards to combine the insulative boards. The sets of the shielding plates decrease signal interference of the receptacle connector and improve signal transmission efficiency and stability.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1 to 4, a crosstalk-proof receptacle connector in accordance with the present invention may be soldered on a PCB and comprises multiple insulative boards 10, multiple sets of terminals, multiple sets of shielding plates 30, an outer casing 40 and a rear assembling cover 50.

Figure 1:
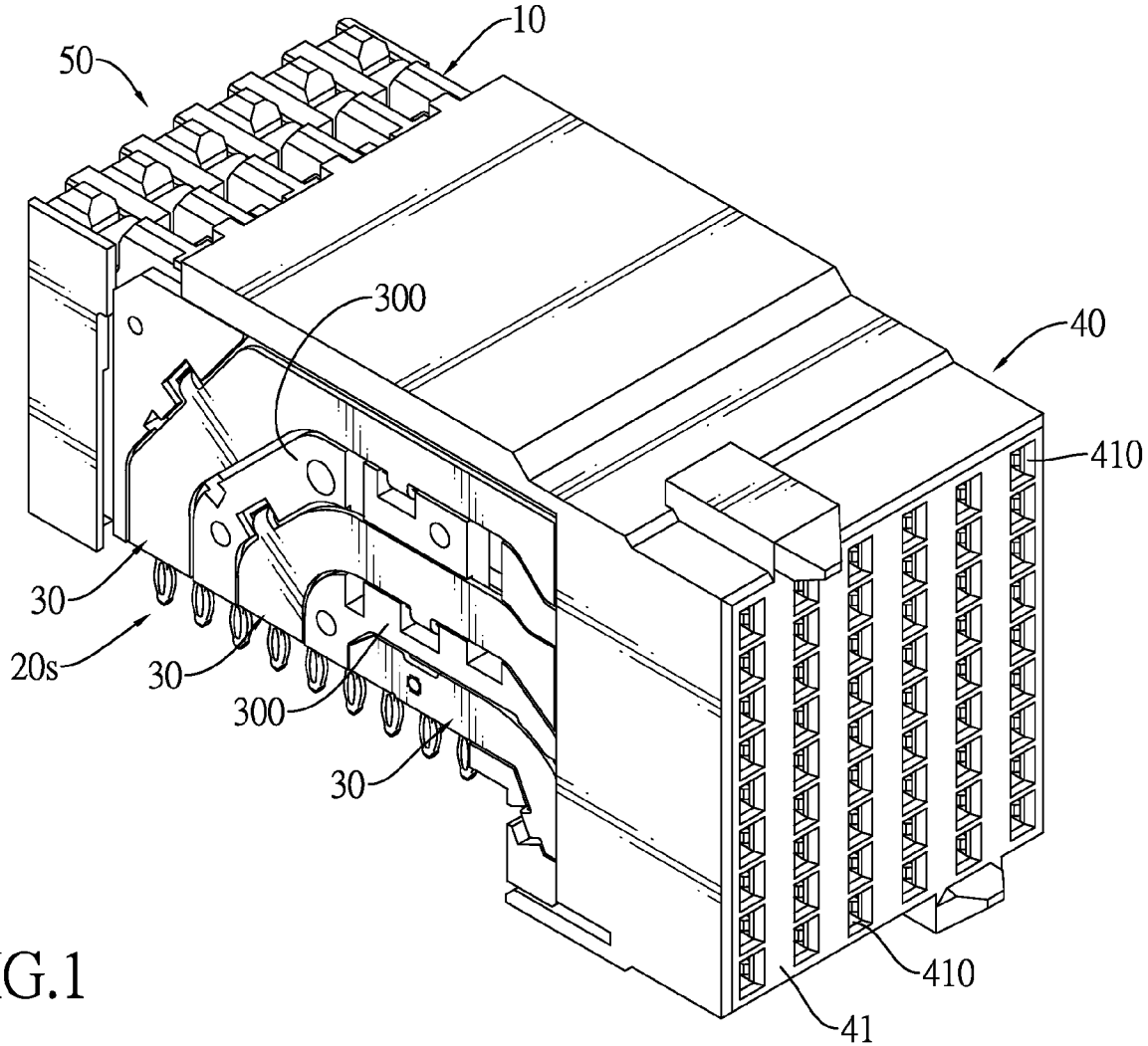
FIG. 1 is a perspective view of a crosstalk-proof receptacle connector in accordance with the present invention.
Figure 2:
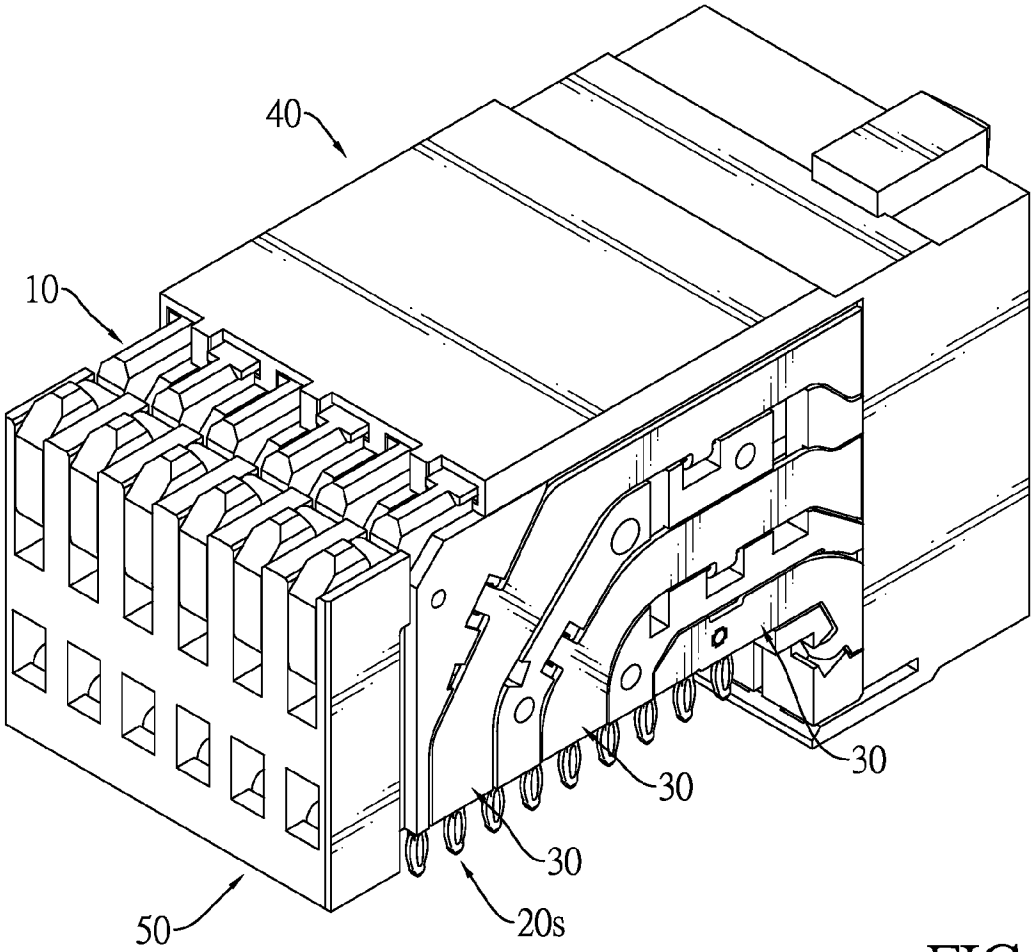
FIG. 2 is another perspective view of the crosstalk-proof receptacle connector in FIG. 1.
Figure 3:
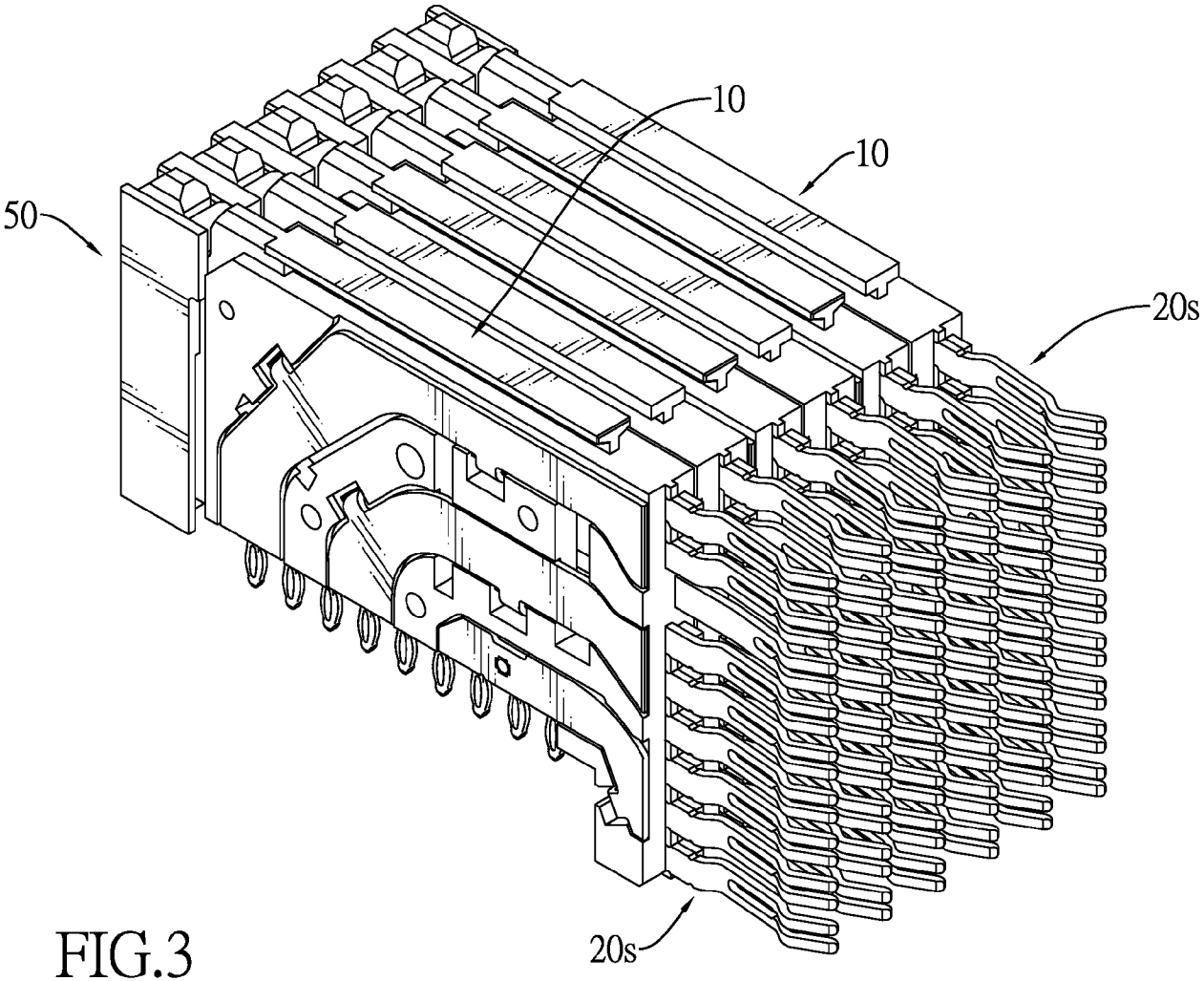
FIG. 3 is a perspective view of the crosstalk-proof receptacle connector in FIG. 2 with the outer casing omitted.
Figure 4:
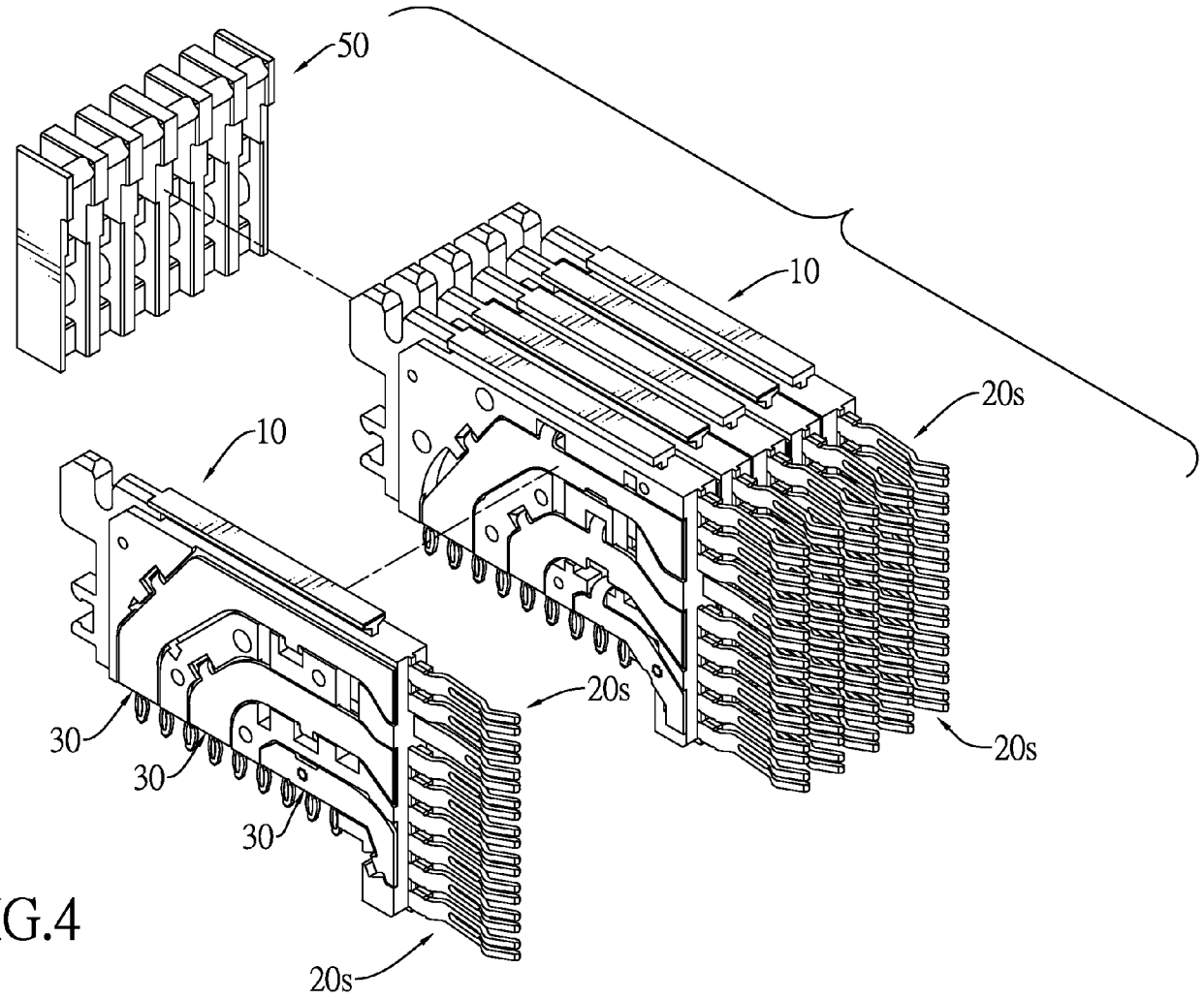
FIG. 4 is an exploded perspective view of the crosstalk-proof receptacle connector in FIG. 3.
Figure 5:
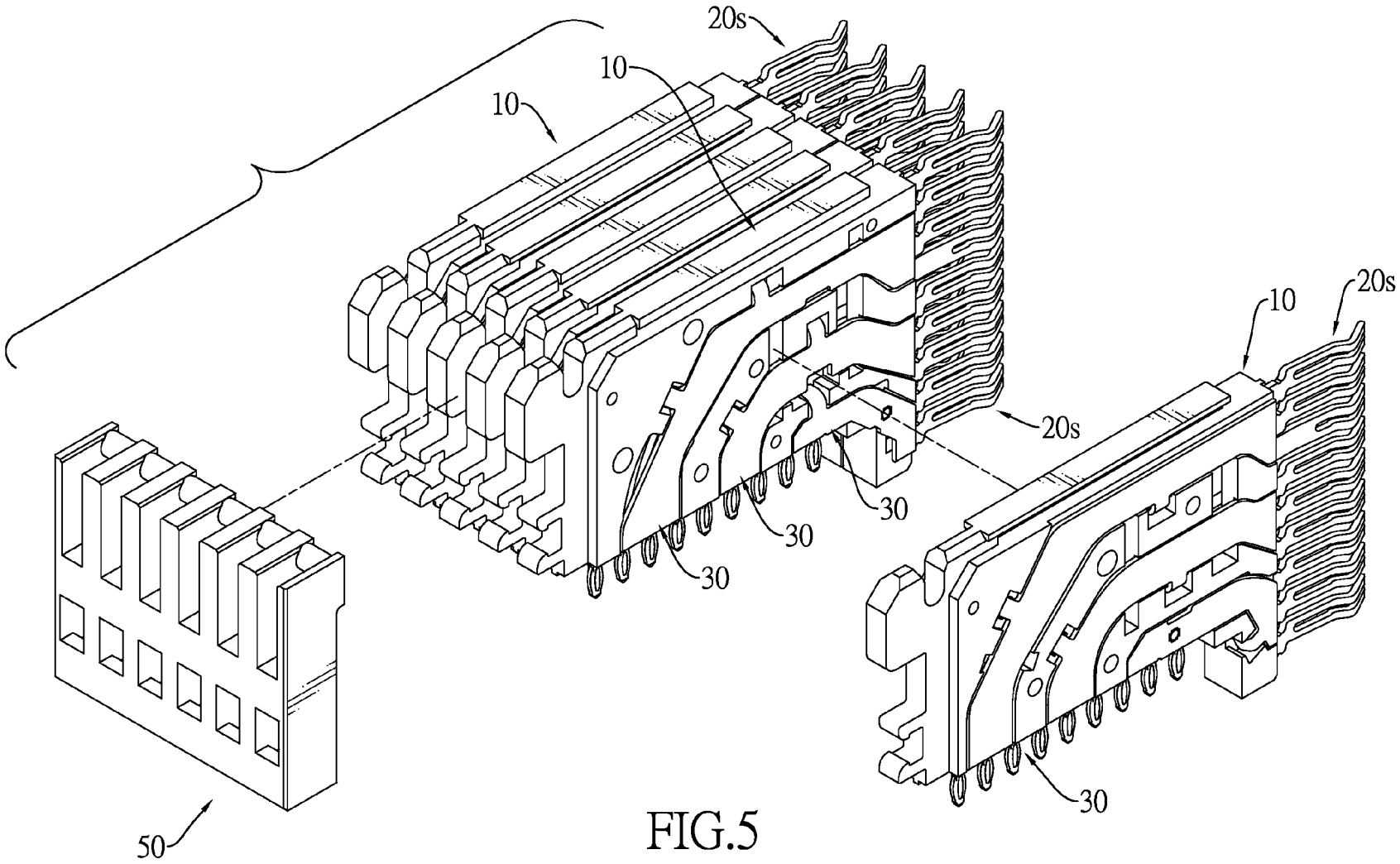
FIG. 5 is another exploded perspective view of the crosstalk-proof receptacle connector in FIG. 3.
Figure 6:
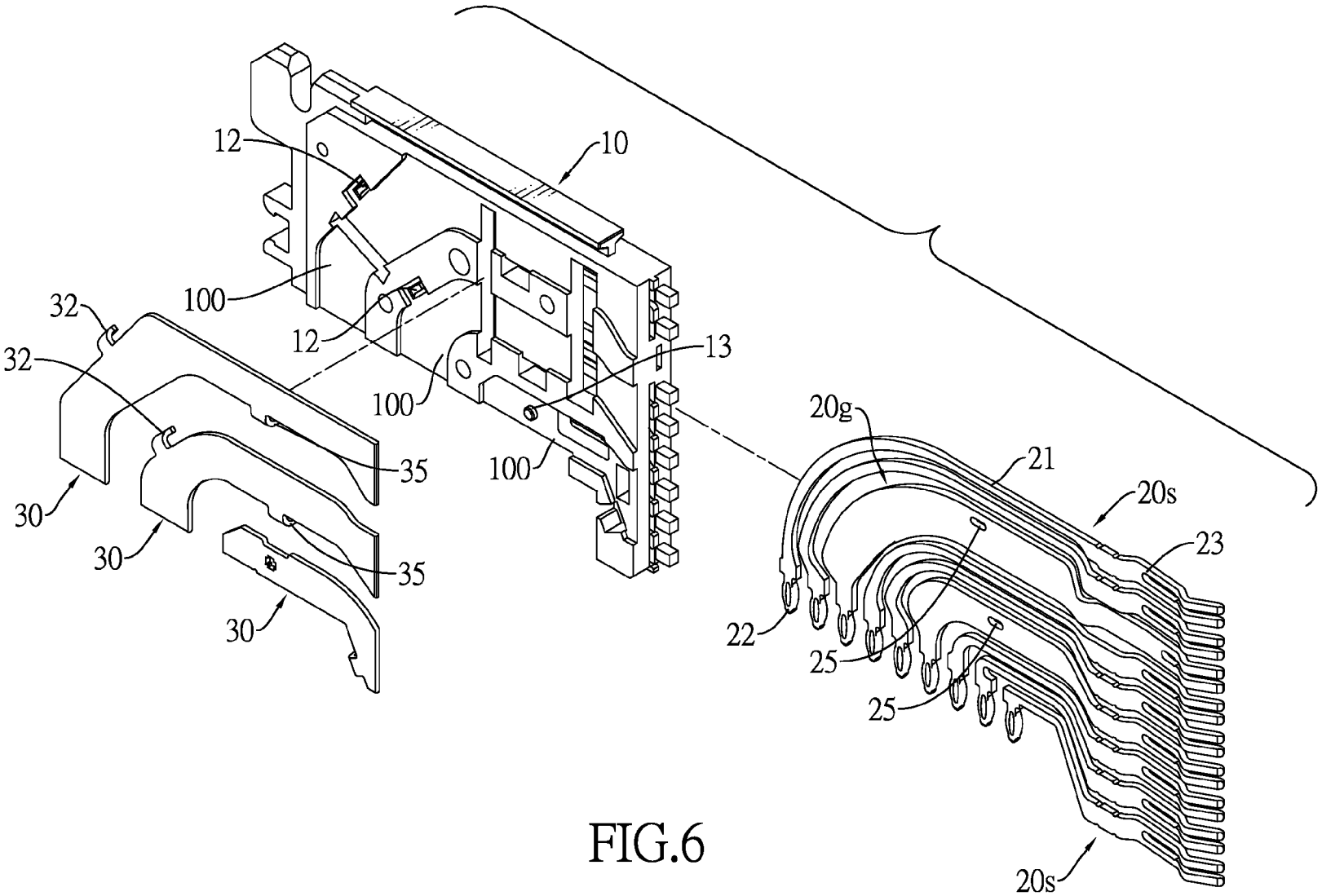
FIG. 6 is an exploded perspective view of an insulative board, a set of terminals and a set of shielding plates of the crosstalk-proof receptacle connector in FIG. 3.

With reference to FIGS. 5 and 6, the insulative boards 10 are arranged abreast and each insulative board 10 has multiple first engaging elements 12, 13 and multiple assembling slots 100.

The first engaging elements 12, 13 are formed on the insulative board 10. The assembling slots 100 are defined in one of two opposite sides of the insulative board 10.

The sets of the terminals are mounted respectively in and correspond to the insulative boards 10 and each set of the terminals are classified into signal terminals 20*s* and grounding terminals 20*g*. Each signal terminal 20*s* or grounding terminal 20*s* has a mounting section 21, an assembling section 22 and an electrical contacting section 23.

The mounting section 21 is embedded in a corresponding insulative board 10.

The assembling section 22 is formed on and protrudes downward from the mounting section 21 and may be soldered or press-fitted on the PCB.

The electrical contacting section 23 is formed on and protrudes forward from the mounting section 21 to electrically contact a terminal of a plug connector corresponding to the crosstalk-proof receptacle connector.

Figure 7:
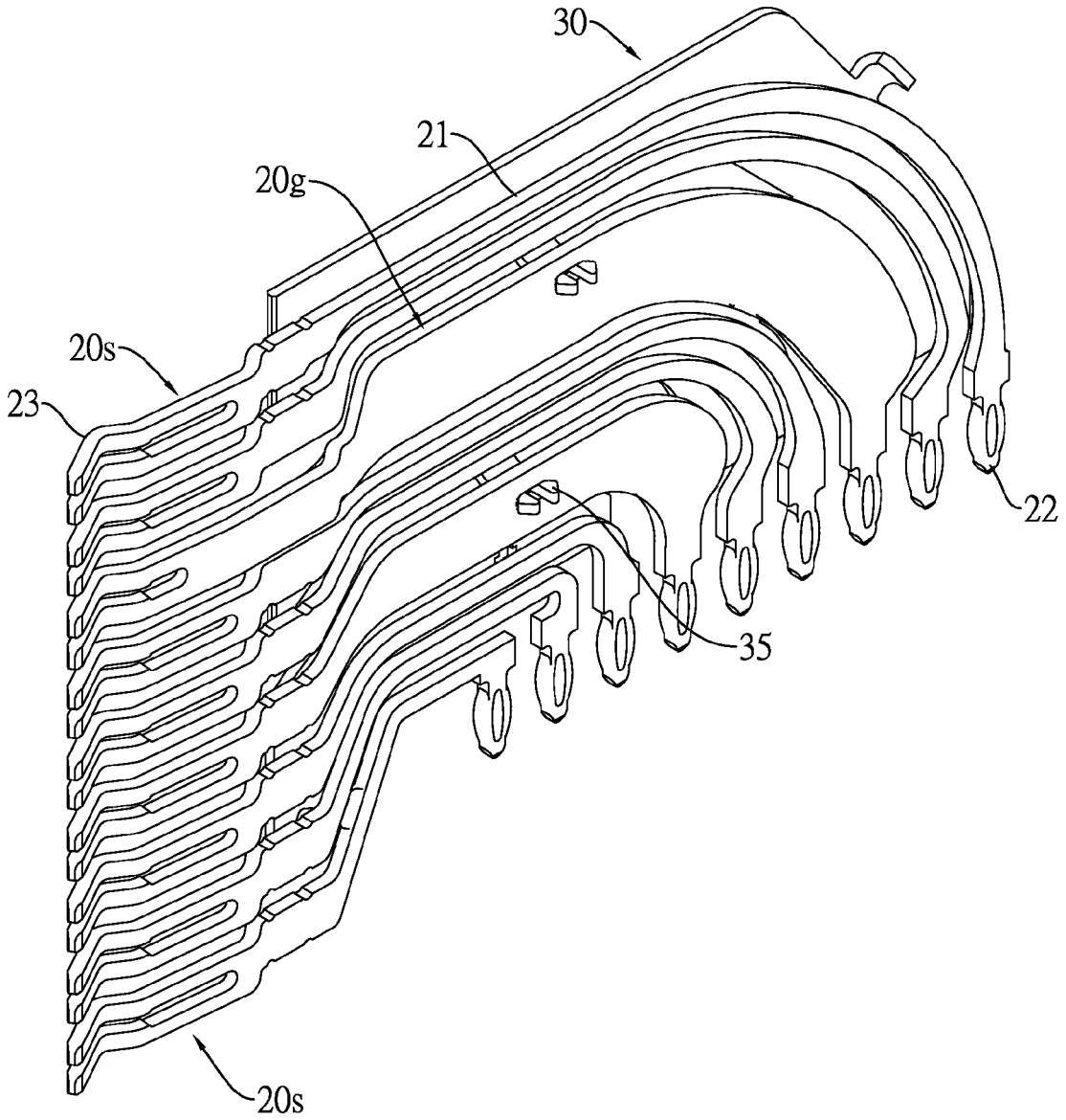
FIG. 7 is a perspective view of the terminals of the crosstalk-proof receptacle connector in FIG. 6.
Figure 8:
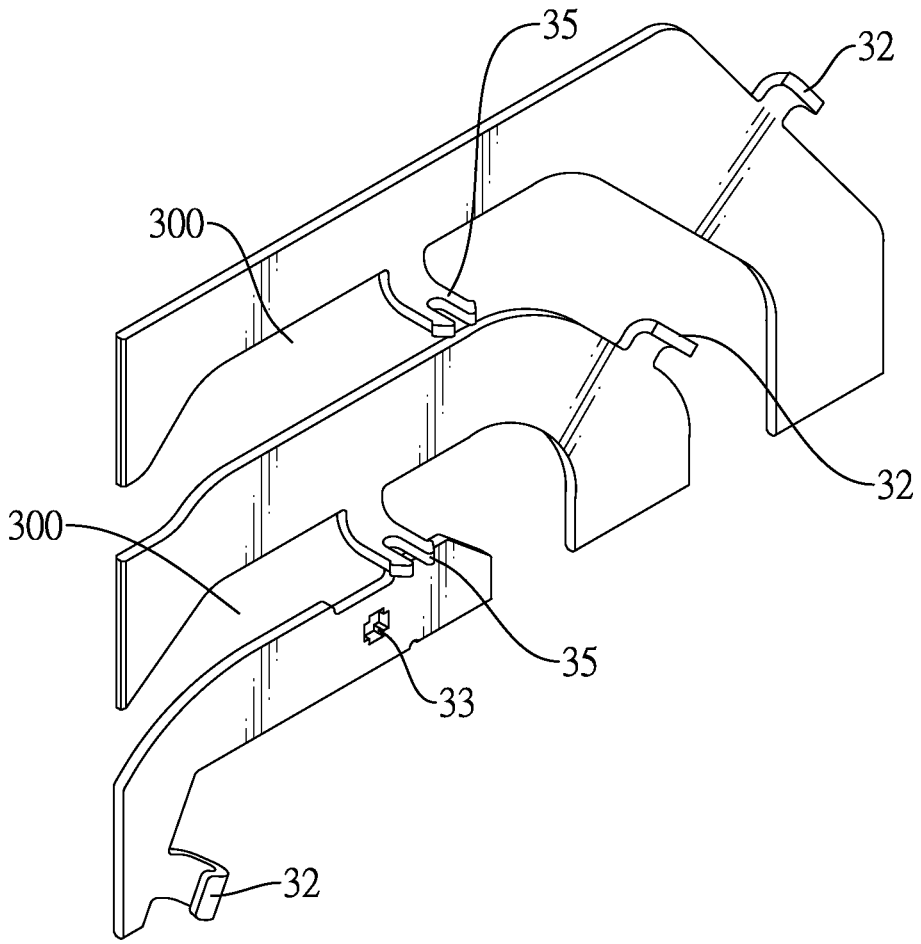
FIG. 8 is a perspective view of the shielding plates of the crosstalk-proof receptacle connector in FIG. 6.
Figure 9:
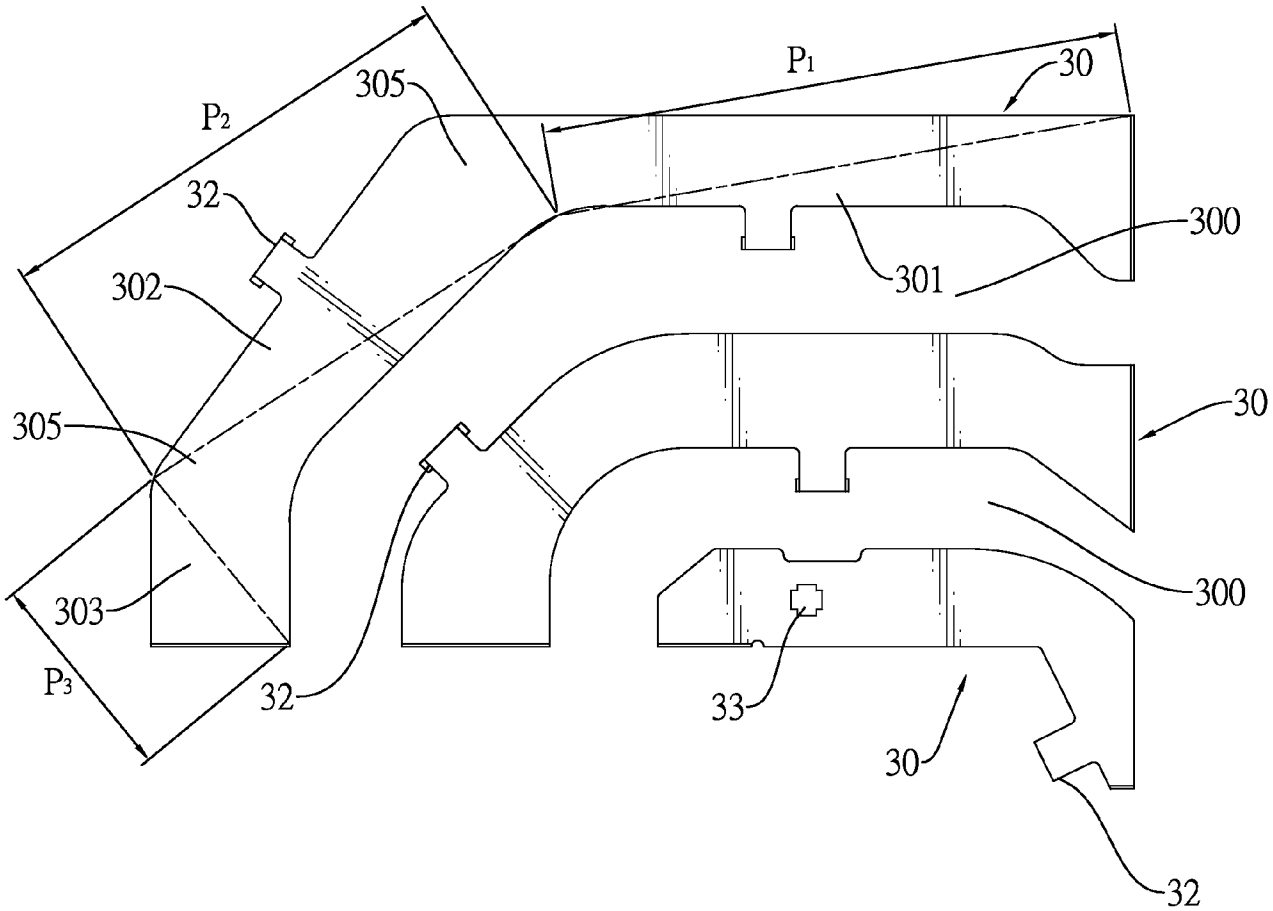
FIG. 9 is a side view of the shielding plates of the crosstalk-proof receptacle connector in FIG. 6.

With further reference to FIGS. 7 to 9, the sets of the shielding plates 30 are used for preventing crosstalk between adjacent signal terminals 20*s*, correspond to the insulative boards 10 and correspond to the sets of the terminals. Each set of the shielding plates 30 is mounted on one side of a corresponding insulative board 10. At least one of the shielding plates 30 of each set is connected to at least one of the grounding terminals 20*g* of a corresponding set. The shielding plates 30 of each set are spaced apart without contacting one another. Each shielding plate 30 has multiple folding sections 305 and multiple straight sections 301, 302, 303. The folding sections 305 are capable of interrupting signal noise. The straight sections 301, 302, 303 are arranged alternately with the folding sections 305, as shown in FIG. 9.

According to antenna effect, an exposed metal piece easily possesses antenna characteristics, collects electric charges to increase electric potential, and then generates current. The current easily runs along a sufficient long path on the metal piece to cause high or low frequency signal interference. Therefore, separating an entire shielding piece into multiple spaced shielding plates 30 effectively decreases antenna effect thereon. In detail, the shielding plate 30 is elongated and has a sufficiently narrow width. Such width is shorter than a single shielding piece as combined by multiple shielding plates 30 so that the spaced shielding plates 30 are able to suppress antenna effect. Furthermore, each shielding plate 30 has the folding sections 305 formed thereon and partitioning the straight sections 301, 302, 303 that are arranged out of a straight line. Also, Paths $P_1$, $P_2$, $P_3$ defined respectively on the straight sections 301, 302, 303 are not arranged in a single straight path so that such folding arrangement disadvantages run of electrical current, as shown in FIG. 9. Therefore, the folding shielding plates 30 further decrease antenna effect.

Furthermore, multiple channel-shaped intervals 300 are defined respectively between adjacent shielding plates 30 of each set. Moreover, each shielding plate 30 of each set has at least one second engaging element 32, 33 that is engaged with the at least one of the first engaging elements 12, 13 of the corresponding insulative board 10. The at least one second engaging element 32, 33 may contact one of the grounding terminals 20*g* so that the shielding plate 30 is able to serve as a grounding element. Further, the shielding plates 30 of each set may be mounted respectively in the assembling slots 100 of the corresponding insulative board 10.

The outer casing 40 covers the insulative boards 10 to combine the insulative boards 10 and has multiple socket holes 410. The socket holes 410 are defined in a front of the outer casing 40 and respectively receive the electrical contacting sections 23 of the terminals.

The rear assembling cover 50 is mounted on rear ends of the insulative boards 10 to ensure that the insulative boards 10 are combined and arranged abreast precisely.

In a preferred embodiment, each first engaging element 12, 13 is a recess or a protrusion, and each second engaging element 32, 33 is a protrusion or a recess corresponding to the recess or protrusion that is the first engaging element 12, 13.

In a preferred embodiment, the at least one of the shielding plates 30 of each set connected to the at least one of the grounding terminals of the corresponding set has a first connecting element 35 formed thereon. The first connecting element 35 may be a hooking tab. Each grounding terminal 20*g* has a second connecting element 25 formed thereon and connected to the first connecting element 35 on the shielding plate 30 that is connected to the grounding terminal 20*g*. The second connecting element 25 may be a hooking hole hooked by the hooking tab.

Figure 10:
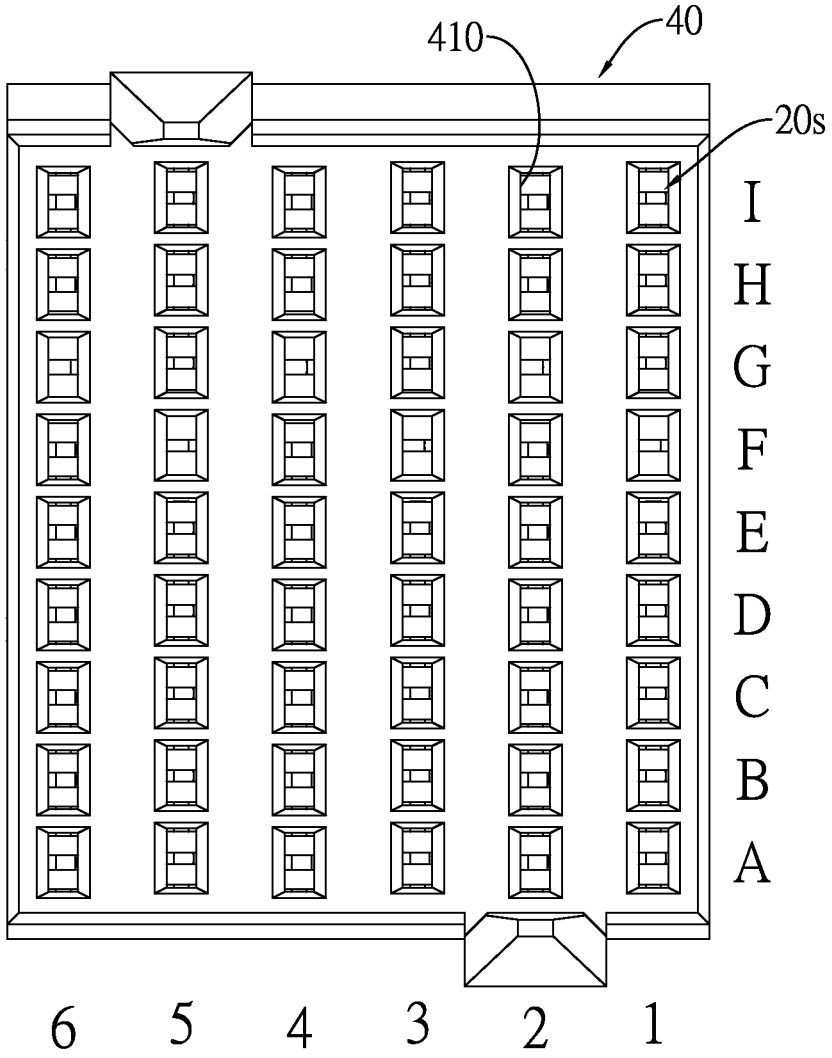
FIG. 10 is a front view of the crosstalk-proof receptacle connector in FIG. 10.

With further reference to FIGS. 10, a signal test is implemented. According to the front view of the socket holes 410, the signal and grounding terminals 20*s*, 20*g* are arranged into an array with A to I rows and 1 to 6 columns. Crosstalk tests respectively between adjacent signal terminals 20*s* are implemented, for example, a crosstalk test of two grounding terminals 20*s* located respectively on coordinates (A, 3) and (B, 3) (the two coordinates are abbreviated to AB3 and similar abbreviations will be done hereafter). The following comparison tables are for the receptacle connector of the present invention with the shielding plates 30 and a conventional receptacle connector without shielding plates.

TABLE 1

Proximal end crosstalk of signal terminal pairs:
Raising time: 55 ps (20-80%)
measurement of peak to peak variation employed

| Coordinates of signal terminals (adjacent signal terminals) | Proximal end crosstalk without shielding plates (%) | Proximal end crosstalk with shielding plates (%) | Difference value |
|---|---|---|---|
| AB3 | 1.48% | 1.04% | 0.44% |
| DE3 | 2.63% | 2.32% | 0.31% |
| GH3 | 1.83% | 1.78% | 0.05% |
| BC2 | 2.05% | 1.88% | 0.17% |
| EF2 | 2.92% | 2.24% | 0.68% |
| HI2 | 0.87% | 0.86% | 0.01% |

TABLE 2

Distal end crosstalk of signal terminal pairs:
Raising time: 55 ps (20-80%)
measurement of peak to peak variation employed

| Coordinates of signal terminals (adjacent signal terminals) | Distal end crosstalk without shielding plates (%) | Distal end crosstalk with shielding plates (%) | Difference value |
|---|---|---|---|
| AB3 | 1.08% | 0.92% | 0.16% |
| DE3 | 1.52% | 1.23% | 0.29% |
| GH3 | 0.96% | 1.00% | −0.04% |
| BC2 | 1.15% | 1.20% | −0.05% |
| EF2 | 1.72% | 1.11% | 0.61% |
| HI2 | 0.86% | 0.94% | −0.08% |

According to the aforementioned comparison tables, the crosstalk of most of the signal terminals 20*s* are lowered after using the shielding plates 30 so that the signal transmission efficiency and stability are improved.

Figure 11:
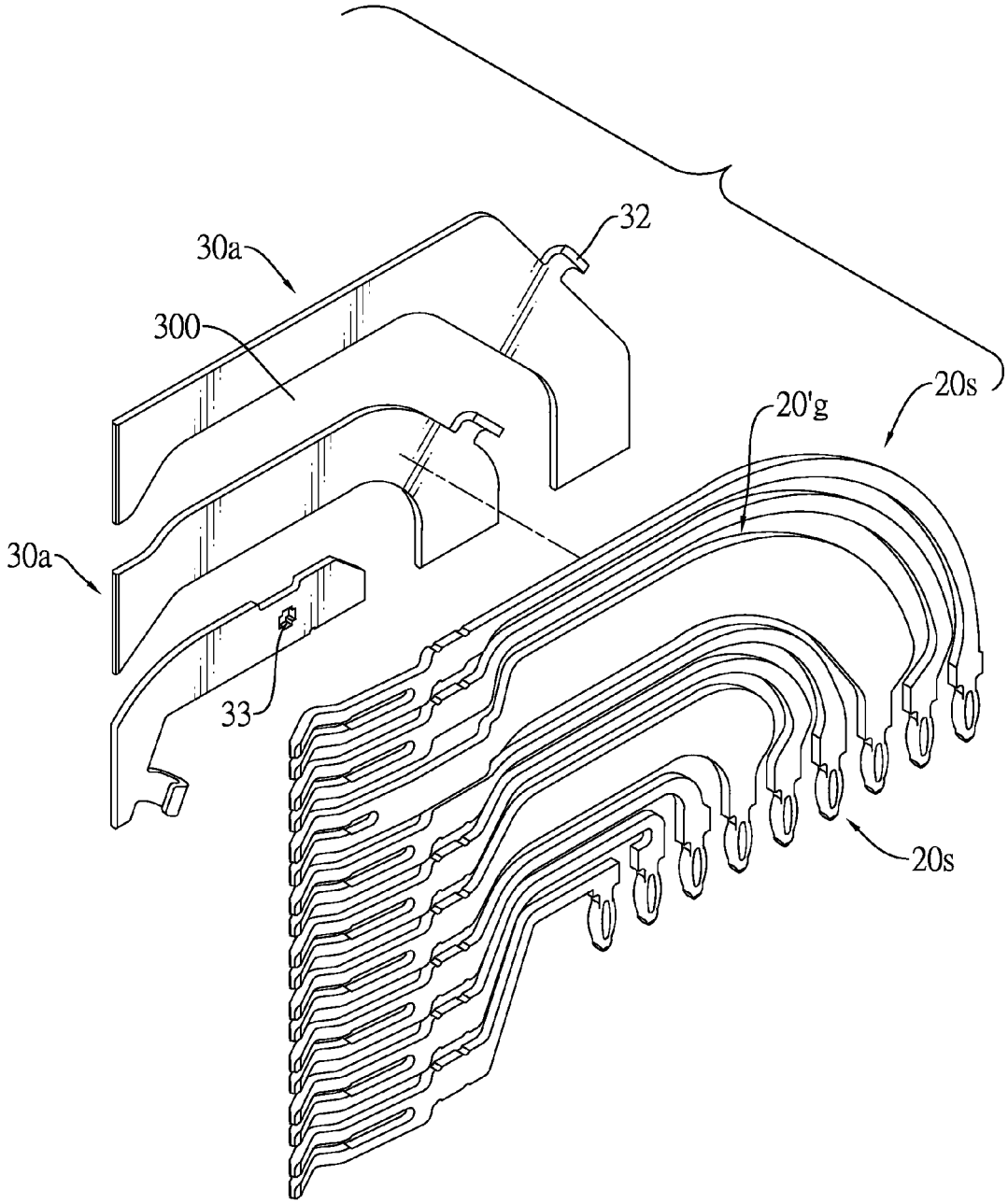
FIG. 11 is a perspective view of the set of the shielding plates and terminals of another embodiment of the crosstalk-proof receptacle connector in accordance with the present invention.
Figure 12:
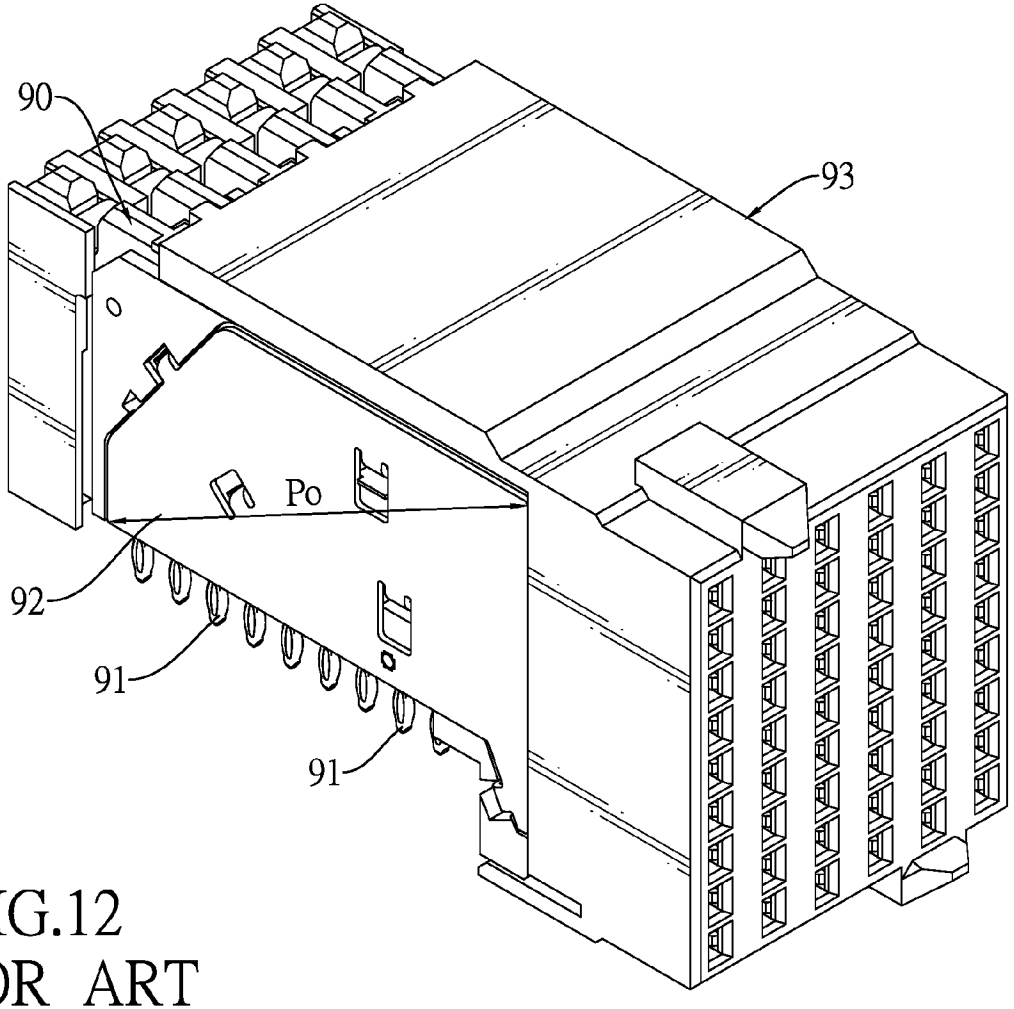
FIG.12 PRIOR ART
FIG. 12 is a perspective view of a conventional connector in accordance with the prior art.

With further reference to FIG. 11, in another embodiment of the present invention, each shielding plate 30*a* does not contact any of the signal terminals 20*s* or grounding terminals 20'*g*. Therefore, each shielding plate 30*a* does not have any first connecting element. Each signal terminal 20*s* or grounding terminal 20'*g* does not have any second connecting element. However, each shielding plate 30*a* still has a second engaging element 32, 33 for engaging the first engaging element 12, 13 of the insulative board 10. Accord ing to the aforementioned description, the present invention has the following advantages.

1. Because each insulative board 10 is mounted with a set of shielding plates 30 on one side to alternately arrange the insulative boards 10 and sets of the shielding plates 30, crosstalk between adjacent sets of terminals 20 is decreased.

2. The shielding plates 30 of each set are elongated and spaced with the channel-shaped intervals 300. Furthermore, each shielding plate 30 has the folding sections 305. Therefore, in comparison with a conventional single piece shielding plate, the shielding plates 30 of the present invention shorten the straight paths $P_1$, $P_2$, $P_3$, avoid antenna effect and excellently suppress crosstalk to improve signal transmission efficiency and stability of the terminals 20.

3. The first connecting element 35 of the shielding plate 30 is connected to the second connecting element 25 of the grounding terminal 20*g* so that the grounding effect is extended to direct the static electricity and signal noise likely causing crosstalk out of the receptacle connector to further improve signal transmission efficiency and stability.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A crosstalk-proof receptacle connector comprising:

multiple insulative boards arranged abreast;

multiple sets of terminals mounted respectively in and corresponding to the insulative boards, each set of terminals comprising signal terminals and grounding terminals arranged in a plane;

multiple sets of shielding plates corresponding to the insulative boards and corresponding to the sets of the terminals, each set of the shielding plates mounted on one of two opposite sides of a corresponding insulative board, at least one of the shielding plates of each set connected to at least one of the grounding terminals of a corresponding set, the shielding plates of each set arranged in a plane and spaced apart without contacting one another after being mounted to the corresponding insulative board, and each shielding plate having multiple folding sections capable of interrupting signal noise; and an outer casing covering the insulative boards to combine the insulative boards, wherein the sets of the shielding plates are arranged alternately with the sets of the terminals such that each of the sets of the shielding plates and each of the sets of the terminals are located respectively in different planes without overlapping one another after being mounted to the corresponding insulative board, and wherein channel-shaped intervals are defined respectively between adjacent shielding plates of each set.

2. The crosstalk-proof receptacle connector as claimed in claim 1, wherein each insulative board has multiple first engaging elements formed on the insulative board; and each shielding plate of each set has at least one second engaging element engaged with the at least one of the first engaging elements of the corresponding insulative board.

3. The crosstalk-proof receptacle connector as claimed in claim 2, wherein each first engaging element is a recess or a protrusion; and each second engaging element is a protrusion or a recess corresponding to the recess or the protrusion that is the first engaging element.

4. The crosstalk-proof receptacle connector as claimed in claim 3, wherein the at least one of the shielding plates of each set connected to the at least one of the grounding terminals of the corresponding set has a first connecting element formed thereon; and each grounding terminal has a second connecting element formed thereon and connected to the first connecting element on the shielding plate that is connected to the grounding terminal.

5. The crosstalk-proof receptacle connector as claimed in claim 4, wherein the first connecting element is a hooking tab; and the second connecting element is a hooking hole hooked by the hooking tab.

6. The crosstalk-proof receptacle connector as claimed in claim 5, wherein each insulative board further has multiple assembling slots defined in one of the two opposite sides of the insulative board; and the shielding plates of each set are mounted respectively in the assembling slots of the corresponding insulative board.

7. The crosstalk-proof receptacle connector as claimed in claim 6 further comprising a rear assembling cover mounted on rear ends of the insulative boards.

8. The crosstalk-proof receptacle connector as claimed in claim 7, wherein each terminal of each set has a mounting section embedded in the corresponding insulative board;

an assembling section formed on and protruding downward from the mounting section; and an electrical contacting section formed on and protruding forward from the mounting section.

9. The crosstalk-proof receptacle connector as claimed in claim 8, wherein each shielding plate further has multiple straight sections arranged alternately with the folding sections.

10. The crosstalk-proof receptacle connector as claimed in claim 1, wherein the shielding plates of each set cover the signal terminals and grounding terminals of the corresponding set of terminals.

11. The crosstalk-proof receptacle connector as claimed in claim 1, wherein the shielding plates of each set are not electrically connected.

* * * * *